United States Patent [19]

Goldberg et al.

[11] 4,143,786

[45] Mar. 13, 1979

[54] ADDITIVE CAP AND SNAP-ON RETENTION RING FOR MEDICAL LIQUID CONTAINER

[75] Inventors: Allan M. Goldberg, Laguna Niguel; Douglas J. Malewicki, Irvine, both of Calif.

[73] Assignee: American Hospital Supply Corporation, Evanston, Ill.

[21] Appl. No.: 879,297

[22] Filed: Feb. 21, 1978

[51] Int. Cl.[2] ..... B65D 45/30

[52] U.S. Cl. ..... 215/274; 292/256.6

[58] Field of Search ..... 215/274, 273, 277, 280, 215/247; 220/256, 258, 319; 292/256.6, 299

[56] References Cited

U.S. PATENT DOCUMENTS

| | | | |
|---|---|---|---|
| 1,525,240 | 2/1925 | Ingram | 215/274 |
| 2,337,616 | 12/1943 | McManus | 220/256 |
| 3,110,411 | 11/1963 | Golde | 215/329 |
| 4,053,052 | 10/1977 | Jasper | 206/439 |

FOREIGN PATENT DOCUMENTS

| | | | |
|---|---|---|---|
| 106261 | 4/1967 | Denmark | 215/274 |

*Primary Examiner*—Donald F. Norton
*Attorney, Agent, or Firm*—Robert E. Hartenberger; Edward A. Figg

[57] ABSTRACT

A snap-on retention ring by which a hospital pharmacist can easily attach an additive cap over a sealed closure of a medical liquid container after the pharmacist has added supplemental medication to the container. The retention ring can be of a bright color as a reminder to a nurse that additive drugs have been applied to the container and special instructions should be read carefully.

8 Claims, 5 Drawing Figures

ADDITIVE CAP AND SNAP-ON RETENTION RING FOR MEDICAL LIQUID CONTAINER

BACKGROUND

As explained in U.S. Pat. No. 4,053,052, a hospital pharmacist frequently adds supplemental medication to an intravenous solution container which has a sealed closure. This patent describes attaching a protective outer cap by means of adhesive for protecting the inner closure during transport from the pharmacy to the operating room or patient's room. Since such outer cap is primarily a dust cover, it need not have the liquid sealing characteristics of the container closure.

The main liquid tight closure of a container often has a cumbersome structure requiring massive screw assembly machines, plastic fusion machines, etc. to insure that an adequate seal has been made in a liquid tight manner on a container for sterile medical solution for introduction into a patient's vein or into a surgical wound. U.S. Pat. No. 3,110,411 shows a threaded screw cap that uses the threaded mechanical advantage to forcibly wedge a stiff snap ring onto a neck flange of a container. The snap ring is preassembled to the screw on cap so the threaded cap can force it in place. It would be burdensome for the pharmacist to manually screw on such closures on a large number of containers to which additive medication is added each day. The various embodiments of this patent have structures indicating this closure is intended to be applied with machinery at the site of manufacture. It would not be well suited for manual assembly in a pharmacy.

Another type of closure suited only for application by a manufacturer is shown in FIG. 7 of U.S. Pat. No. 3,205,889. Here heat fusion type sealing equipment is necessary to seal retaining ring material to a container (plastic bag).

SUMMARY OF THE INVENTION

The present invention deals with an outer dust cover protector that is easily applied to an I.V. or pouring container after supplemental medications have been added. Beneath this dust cover is a conventional liquid tight closure. The dust cover with its external flange is easily placed over the closure with a simple axial motion and held in place with a thin retention ring that snaps in place with simple axial motion. Once the cap has been pulled apart from the snap ring, it is very difficult to reassemble the cap and snap ring, and thus acts to show that the protective cap has been tampered with. Preferably the snap-on retention ring has a plurality of spaced apart flexible lugs to overlie the cap flange to make removal of the cap from the retention ring easy. Also, it is preferred to have a plurality of spaced cam locks to snap under a neck flange of a container without the requirement for excessive axial force. Such retention ring is easy for a pharmacist to manually apply to a container without the necessity for heavy machinery.

THE DRAWINGS

DETAILED DESCRIPTION

Figure 1:
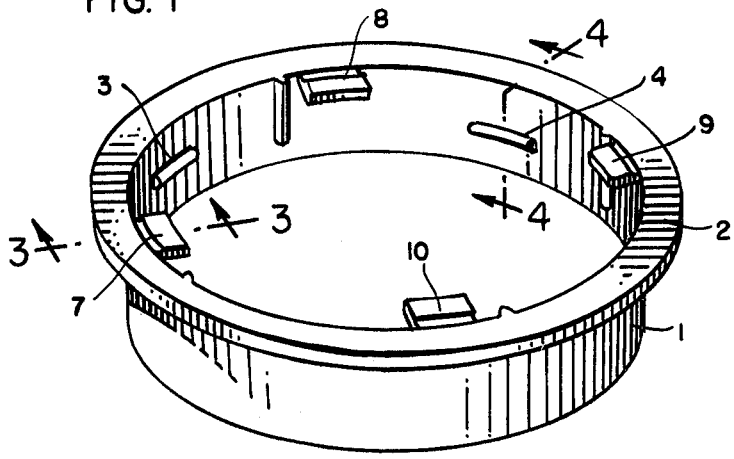
FIG. 1 is a prospective view of the snap retention ring.

The retention ring shown in FIG. 1 includes a skirt section 1 which is integrally connected to a stiffening flange 2. On an inner surface of skirt 1 are a series of circumferentially spaced cam locks, two of which are shown at 3 and 4. These cam locks are adapted to snap under a neck flange 5 of a container 6.

Figure 2:
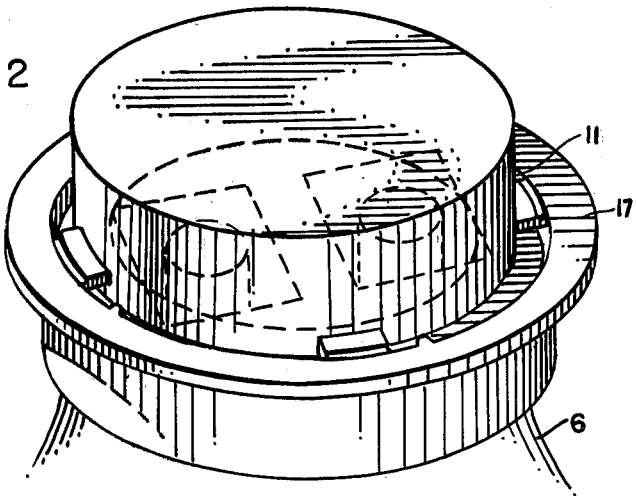
FIG. 2 is a prospective view of an additive cap assembled to an I.V. solution container.

Assembly of the retention ring to container 6 is accomplished by a simple axial downward pushing motion. The upper surface of strengthening flange 2 provides a very convenient flat area for applying this pushing pressure. The edge of the flange being radiused to provide a smooth surface with no sharp corners is a means for eliminating concentrated forces on the user's fingertips. Once assembled to container 6, resilient lugs 7, 8, 9, and 10 are equally spaced about a perimeter of an inner edge of the skirt 1, engage an upper surface of additive cap flange 10. This holds the additive cap firmly to the flange 5 of container 6. A hollow crown section 11 of the cap encases the dispensing ports shown in dotted line of the I.V. solution container of FIG. 2. It is understood that one of these ports would have been opened to administer the additive medication through a puncturable resealable rubber diaphragm.

Figure 3:
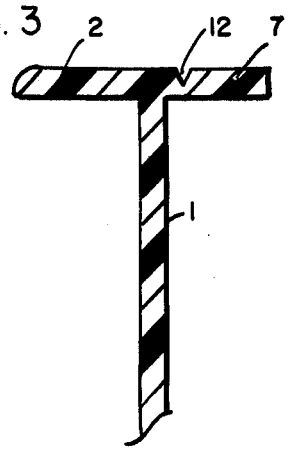
FIG. 3 is a sectional view taken along line 3—3 of FIG. 1.
Figure 4:
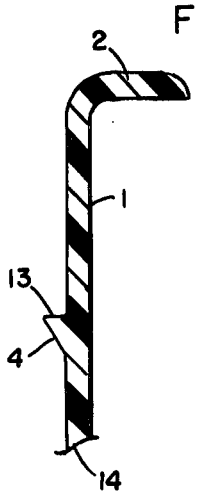
FIG. 4 is a sectional view taken along line 4—4 of FIG. 1.

As shown in FIG. 3, the lug 7 has a V-shaped groove 12 forming a hinge section of lug 7. During removal of the additive cap, such hinge section helps lug 7 flex upwardly to release the flange 10 of the cap. The retention ring, preferably made of a thermoplastic material such as polypropylene, has a plastic memory tending to cause lug 17 to return to its unhinged position shown in FIG. 3 after removal of the additive caps. This makes it extremely difficult to reassemble the additive cap beneath the lug. One would need to manually pry up all four lugs shown in FIG. 1 to place the flange 17 of the additive cap beneath the lugs.

Spaced between the lugs 7, 8, 9, and 10 are a series of cam locks, such as 4, which have tapered lead-in surfaces to snap over the additive cap flange 10 and container flange 5. Shoulder sections such as shown at 13, snaps beneath flange 5 of the container. The cam lock can be equally spaced about a perimeter of the retention ring. Preferably a lower end of the skirt 1 has a beveled surface 14 to aid in positioning the retention ring over the additive cap.

A second function of bevel surface 14 is to stop against the bottle shoulder so that the retention ring cannot be pushed on too far. Without this stop feature, hinges 7, 8, 9, 10 would flex completely open and the ring would not hold the dust cap.

Figure 5:
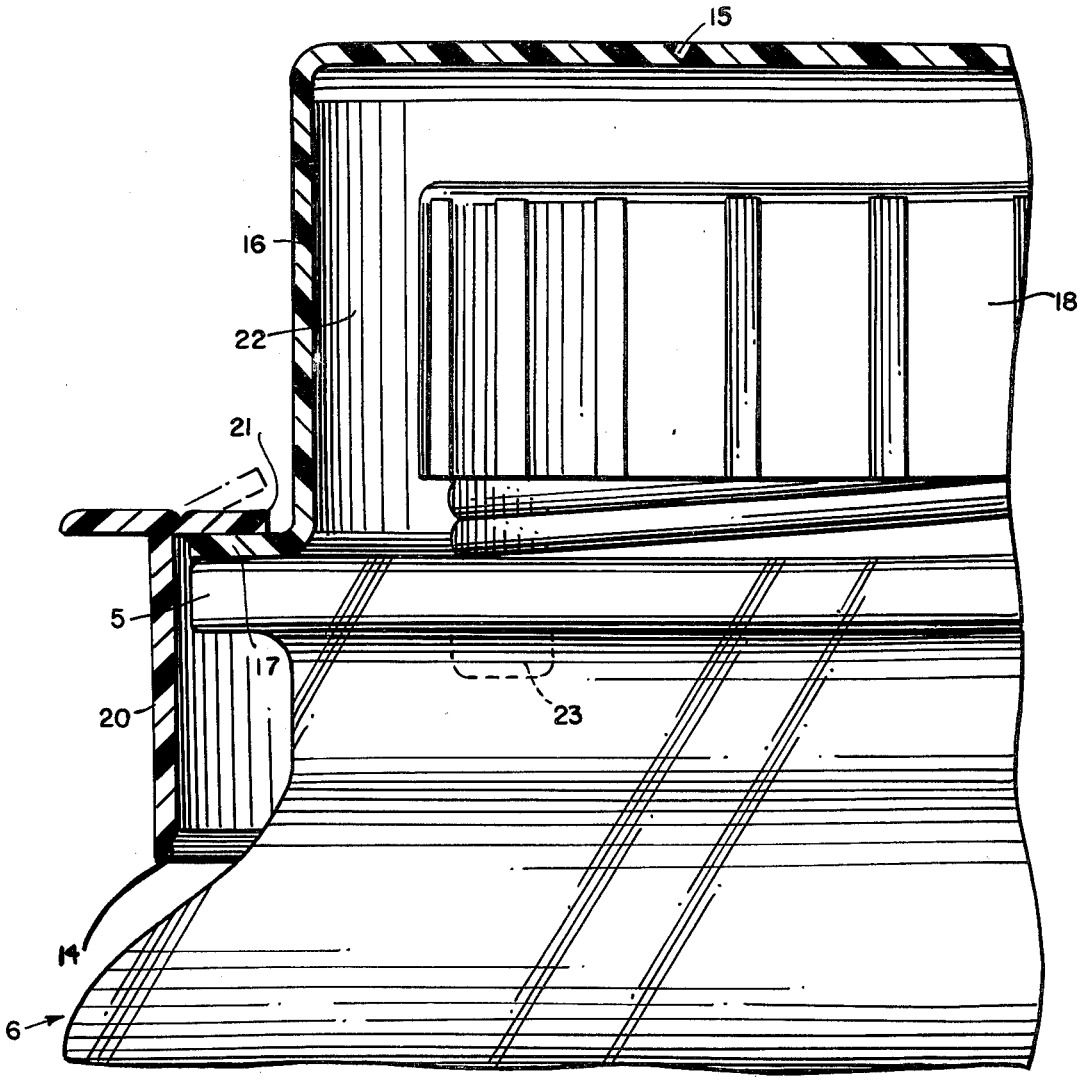
FIG. 5 is an enlarged fragmentary sectional view showing the additive cap and retention ring assembled to a pouring container.

In FIG. 5, an enlarged additive cap with a top wall 15, a depending wall 16, and a flange 17 is shown assembled to a pouring container. The pouring container differs from an I.V. container in that it has a wide mouth dispensing outlet which is closed by a threaded closure 18. A pouring container is used to quickly flush a surgical wound with sterile liquid simply by pouring it into the wound and then removing it with suction equipment.

As seen in FIG. 5, a skirt 20 of a retention ring has a lug 21 which is shown in flexed condition in dotted lines. It is understood that the flexing of lug 21 is shown schematically. In practice, when the additive cap flange 17 is pulled from the lug 21, there is a certain amount of flexing in both flange 17 and lug 21. During removal of the additive cap, it is preferable to cock the additive cap slightly to relieve flange 17 from one lug first. The additive cap can then be more easily pulled axially from the container. It is noted that the additive cap is not supported by screw threads, etc. on the inner liquid tight closure 18. There is a space 22 permitting easy axial removal, as well as the preferred initial cocking motion as explained. Once the additive cap has been removed, the cam locks, such as 23, keeps the retention ring attached to the container.

The retention ring described above provides an easy way for a hospital pharmacist to attach the protective additive cap to the container with simple manual motion without expensive heat sealing or other mechanical machinery. It can be of a bright color, such as red, for easy identification.

In the above description, specific examples have been used to describe the invention. However, it is understood that those skilled in the art can make certain modifications to these examples without departing from the spirit and scope of the invention.

We claim:

1. A container with an outlet sealed by a closure wherein the improvement comprises: an additive cap having an external flange fitting over the closure and spaced a sufficient distance from the closure for axial separation of the additive cap and closure; and a snap-on retention ring having a plurality of flexible lugs overlying the additive cap flange and releasably securing the additive cap to the container.

2. A container as set forth in claim 1, wherein the flexible lugs are approximately equally spaced about a perimeter of the retention ring.

3. A container as set forth in claim 1, wherein the flexible lugs include a hinge section.

4. A container as set forth in claim 5, wherein the hinge section includes a generally V-shaped groove.

5. A container as set forth in claim 1, wherein the retention ring has a plurality of cam locks for snapping under a neck flange of a container.

6. A container as set forth in claim 5, wherein the cam locks are spaced about the periphery of the retention ring and located between the flexible lugs.

7. A container for medical liquids with closures over all access ports, a secondary protective cap and a snap-on retention ring releasably securing said cap, but preventing its replacement.

8. A retention ring for attaching an additive cap to a container, which retention ring includes a skirt; a plurality of peripherally spaced flexible lugs for overlying a portion of an additive cap; and a plurality of peripherally spaced cam locks adapted to snap under a container flange to hold the additive cap to such container.

* * * * *